US007330678B2

(12) United States Patent
Kadowaki et al.

(10) Patent No.: US 7,330,678 B2
(45) Date of Patent: Feb. 12, 2008

(54) WASTE DEVELOPER COLLECTING CONTAINER FOR IMAGE FORMING APPARATUS

(75) Inventors: Hideaki Kadowaki, Kyoto (JP); Susumu Murakami, Kyoto (JP)

(73) Assignee: Sharp Kabushiki Kaisha, Osaka (JP)

( * ) Notice: Subject to any disclaimer, the term of this patent is extended or adjusted under 35 U.S.C. 154(b) by 152 days.

(21) Appl. No.: 11/245,552

(22) Filed: Oct. 7, 2005

(65) Prior Publication Data

US 2006/0083540 A1 Apr. 20, 2006

(30) Foreign Application Priority Data

Oct. 19, 2004 (JP) ..... 2004-304531
Sep. 7, 2005 (JP) ..... 2005-259683

(51) Int. Cl.
*G03G 15/08* (2006.01)
*G03G 21/12* (2006.01)

(52) U.S. Cl. ..... 399/102; 399/360

(58) Field of Classification Search ..... 399/102, 399/109, 358, 360
See application file for complete search history.

(56) References Cited

U.S. PATENT DOCUMENTS 5,761,577 A * 6/1998 Walsh et al. ..... 399/358 X
5,937,235 A * 8/1999 Huss et al. ..... 399/102
6,018,637 A * 1/2000 Huss et al. ..... 399/102

FOREIGN PATENT DOCUMENTS

JP 4-61375 5/1992
JP 11-288155 10/1999

* cited by examiner

*Primary Examiner*—Sandra L. Brase
(74) *Attorney, Agent, or Firm*—Renner, Otto, Boisselle & Sklar, LLP

(57) ABSTRACT

A waste toner collecting container which is used in a color image forming apparatus and can be removed from the machine and stores waste toner particles which have not been transferred to recording paper and have been collected, is constructed such that an air sealing member is disposed at the coupling between the waste toner collecting container and a conveying member for conveying the collected waste toner into the waste toner collecting container to prevent the waste toner from seeping out at the coupling when the waste toner is conveyed and to seal the collecting port so that no waste toner will spill out from the waste toner collecting container which has been removed for replacement after the waste toner collected and conveyed therein has reached the predetermined amount.

9 Claims, 9 Drawing Sheets

WASTE DEVELOPER COLLECTING CONTAINER FOR IMAGE FORMING APPARATUS

This Nonprovisional application claims priority under 35 U.S.C. § 119(a) on Patent Application No. 2004-304531 filed in Japan on 19 Oct. 2004 and Patent Application No. 2005-259683 filed in Japan on 7 Sep. 2005, the entire contents of which are hereby incorporated by reference.

BACKGROUND OF THE INVENTION (1) Field of the Invention

The present invention relates to a waste developer collecting container for use in an electrophotographic image forming apparatus, for storing the developer particles which, of the developer used for developing images of information formed on an electrostatic latent image bearing member, have not been transferred to recording mediums such as recording paper and the like and have been collected as waste developer.

(2) Description of the Prior Art

The developers (called "toner") used in image forming apparatuses are small-diametric particles, so that there is a fear that the developers have an effect on the human body if users by themselves dispose of them. Therefore, the manufactures have been mandated to take the responsibility for collection and disposal of the developers as industrial waste.

With regard to the handling of such industrial waste, it is not only necessary to take safety measures for the users, but also establish adequate safeguard for the workers in charge of disposal on the manufacture side.

In the image forming apparatuses, to visualize an image of information on a sheet of paper as a recording medium, a visual image is formed first on an electrostatic latent image bearing member (photoreceptor) with a toner as a developer having a color such as black or other colors so as to, and then transferred to the paper. This transfer process, however, is not able to gain a transfer efficiency of 100% but usually yields a transfer efficiency of 80 to 95%.

If a next printing operation is started without the toner remaining on the photoreceptor cleaned, the print quality at the next printing will be degraded. This is why the photoreceptor, after the transfer process, is subjected to a cleaning process in which the leftover toner on the photoreceptor is removed by a cleaning unit.

The toner collected by this cleaning process is brought together into a waste toner box and will be disposed of as stated above.

Taking the environmental issues into account, this container for collection and disposal of the toner should be reused while the waste toner is discarded as industrial waste.

Further, it is impermissible that waste toner should scatter from the container holding waste toner during its transportation, also it should never be the case that waste toner seeps out from the waste toner collecting container attached to the machine and contaminate the machine and the surroundings around the machine.

For this purpose, a waste toner collecting container is required to be able to seal waste toner therein and have hermetic sealability.

In Japanese Patent Application Laid-open Hei 11 No. 288155 (patent literature 1), it is disclosed that, in a re-packaging unit of a used and replaced toner cartridge, in order to prevent toner from scattering from a toner cartridge to which toner is collected, a collecting kit including a seal for sealing the opening through which toner may spill out from the toner cartridge when the cartridge is collected, written operation instructions for describing the re-packaging procedures at collection and/or a label for the address to the collecting site is packed together with the toner cartridge when the product is shipped.

However, the prior art methods, inclusive of the above patent literature 1, suffer the problem that in order to collect the used toner cartridge, the user needs to make an effort to take out the seal from the collecting kit and attach it to the opening through which toner may spill out.

Further, it is troublesome for an unfamiliar user to apply the seal to prevent toner from spilling out even if the person does it referring to the written instructions, hence the remaining toner may scatter and the scattered toner may pollute the user's hands. There still remains the problem that it takes a rather longer time than when a maintenance personnel or other skilled person does the work.

SUMMARY OF THE INVENTION

The present invention has been devised in order to solve the above problems, it is therefore an object of the present invention to provide a waste developer collecting container which is used in an image forming apparatus and can be recycled and improved in the sealing performance for reliably preventing waste developer from scattering while it is mounted and being used and also improved in the hermetic sealability for reliably preventing waste developer from leaking from the waste toner collecting container when it has been removed and also facilitates simple sealing work.

In order to achieve the above object, the waste developer collecting container of an image forming apparatus has the following configuration.

According to the present invention, a waste developer collecting container which is used in an image forming apparatus and can be removed therefrom and stores developer particles which, of the developer used for developing images of information formed on an electrostatic latent image bearing member, have not been transferred to recording mediums and have been collected as waste developer, is characterized in that an air sealing member is disposed at the coupling between the waste developer collecting container and a conveying member for convening the collected waste developer into the waste developer collecting container through a collecting port to prevent the waste developer from spilling out at the coupling when the waste developer is conveyed and to seal the collecting port so that no waste developer will spill out from the waste developer collecting container which has been removed for replacement after the waste developer collected and conveyed therein by the conveying member has reached the predetermined amount.

In the present invention, it is preferable that the waste developer collecting container can be reused by attaching a new air sealing member around the collecting port of the waste developer collecting container.

In the present invention, it is also preferable that the air sealing member comprises a seal, an adhesive and a waste developer anti-scatter member made of a foaming or an elastic element.

In the present invention, it is preferable that the air sealing member is composed of a first adhesive, a first seal, a second adhesive, a second seal, a third adhesive and a foaming, all having an opening corresponding to the collecting port, laminated in the order mentioned, from the waste developer collecting container side to the opposite side in the coupling.

In the present invention, it is also preferable that the air sealing member attached to the waste developer collecting container is disposed at the coupling so as to allow a conveying member to be inserted through the opening.

In the present invention, it is preferable that the waste developer collecting container is sealed by the steps of peeling the second seal from the second adhesive of the air sealing member disposed around the collecting port after disengagement of the waste developer collecting container from the toner conveying member when the waste developer reaches the predetermined amount; and folding up the part other than the opening and there around of the first seal toward the opening.

Further, in the present invention, it is preferable that recycling of the waste developer collecting container is made possible by removing the entire air sealing member that is sealing the collecting port of the waste developer collecting container, or removing the first seal of the air sealing member and then placing a new air sealing member to the waste developer collecting container.

Also in the present invention, it is preferable that the air sealing member is composed of a first adhesive, a first seal, a second adhesive, a second seal, a third adhesive and an elastic element, all having an opening corresponding to the collecting port, laminated in the order mentioned, from the waste developer collecting container side to the opposite side in the coupling, and the elastic element is formed of a plurality of projecting pieces that project from the periphery thereof toward the central axis of the opening and cover the opening and is constructed such that the opening can be opened by pushing the projecting pieces.

Further, in the present invention, it is preferable that the air sealing member is constructed such that when the conveying member is attached to the collecting port of the waste developer collecting container the projecting pieces are pushed apart by the conveying member so that the projecting pieces will be elastically deformed to open the opening and when the conveying member is removed from the collecting port, the projecting pieces return to the position closing the opening.

Moreover, in the present invention, it is preferable that the elastic element has an essentially flat sheet-like configuration, cut by radial slits from the rim to the center, so that a plurality of projecting pieces attached at the rim are formed in the center.

Finally, in the present invention, it is preferable that the first seal and the second seal are joined to each other at their respective ends opposite to their respective openings with respect to the planar direction, and the third adhesive and the elastic element are laminated on the second seal, and upon replacement of the waste developer collecting container, the second seal is peeled off, together with the third adhesive and the elastic element, from the collecting port side, and the peeled second seal and the elastic element are made to stick to the wall surface of the collecting container.

According to the waste developer collecting container of an image forming apparatus of the present invention, the air sealing member is able to provide a reliable sealing function of preventing waste developer from scattering through the coupling when the waste developer collecting container is being mounted in the image forming apparatus. Further, since the air sealing member also seals the collecting port of the waste developer collecting container when the waste developer collecting container is removed for replacement, it is possible to reliably prevent waste developer from spilling out from the collecting container when the container is handled or transported to the manufacturer.

As a result, it is possible to reuse the waste developer collecting container and also improve the sealing performance of reliably preventing waste developer from scattering while the container is mounted and being used and the hermetic sealability for reliably preventing waste developer from spilling out from the waste developer collecting container when it has been removed. This configuration also facilitates simple sealing work.

Further, in the present invention, when the waste developer collecting container is configured so as to be reused by attaching a new air sealing member around the collecting port of the waste developer collecting container, the collecting container can be recycled easily.

In the present invention, when the air sealing member is made up of a seal, an adhesive and a waste developer anti-scatter member made of a foaming or an elastic element, it is possible to provide the sealing function and hermitic sealability with a simple configuration.

In the present invention, when the air sealing member is made up of a first adhesive, a first seal, a second adhesive, a second seal, a third adhesive and a foaming, all having an opening corresponding to the collecting port, laminated in the order mentioned, from the waste developer collecting container side to the opposite side in the coupling, it is possible to create a laminated structure which can set up desired hermitic sealability and it is also possible to peel off the seal in an easy manner, owing to provision of the adhesive.

In the present invention, when the air sealing member attached to the waste developer collecting container is disposed at the coupling so as to allow a conveying member to be inserted through the opening, it is possible to seal the coupling of the waste developer collecting container with the conveying member, at and all around the collecting port, hence it is possible to improve the hermetic sealability and definitely prevent waste developer from leaking from the waste developer collecting container, on the occasion of recycling.

In the present invention, since the second seal is peeled from the second adhesive of the air sealing member disposed around the collecting port after disengagement of the waste developer collecting container from the toner conveying member when the waste developer reaches the predetermined amount, and the part other than the opening and there around of the first seal is folded up toward the opening, the second seal is able to secure the closure of the collecting port with the first seal. Thus, it is possible to reliably seal the waste developer collecting container. Accordingly, in sealing the collecting port after the waste developer collecting container is removed, when the second seal of the air sealing member is peeled from the second adhesive, the second adhesive is left over on the first seal after peeling. As the first seal is folded up, opposing areas of the second adhesive robustly bond to each other. Thus it is possible to concisely and reliably seal the collecting port by the first seal without the necessity of applying any extra adhesive etc.

Further, in the present invention, recycling of the waste developer collecting container is made possible by removing the entire part air sealing member that is sealing the collecting port of the waste developer collecting container, or removing the first seal of the air sealing member and then placing a new air sealing member on the waste developer collecting container. Since the air sealing member is applied by means of the first adhesive when the air sealing member is totally peeled off, the air sealing member can be fixed with a strong bonding force of the fresh first adhesive. On the other hand, when the air sealing member is peeled off inclusive of the first seal, the first adhesive remains on the waste developer collecting container side. Accordingly, when a new air sealing member is to be applied, one with its first adhesive absent may be used for applying, it is therefore possible to simplify the structure of the air sealing member for recycling the waste developer collecting container. Also, this configuration will save the effort of removing the first adhesive, hence is able to simplify the work for recycling the waste developer collecting container.

In the present invention, the air sealing member is composed of a first adhesive, a first seal, a second adhesive, a second seal, a third adhesive and an elastic element, all having an opening corresponding to the collecting port, laminated in the order mentioned, from the waste developer collecting container side to the opposite side in the coupling, and the elastic element is formed of a plurality of projecting pieces that project from the periphery thereof toward the central axis of the opening and cover the opening and is constructed such that the opening can be opened by pushing the projecting pieces. It is therefore possible to definitely prevent the waste developer from spilling out or scattering by means of the projecting pieces even if some waste developer remains at and around the opening when the container is removed from the coupling.

In the present invention, the air sealing member is constructed such that when the conveying member is attached to the collecting port of the waste developer collecting container the projecting pieces are pushed apart by the conveying member so that the projecting pieces will be elastically deformed to open the opening and when the conveying member is removed from the collecting port, the projecting pieces return to the position closing the opening. Accordingly, when the waste developer collecting container is attached to the image forming apparatus, the conveying member is pushed into the projecting pieces, passing through the opening so that it can be attached to the collecting opening. On the other hand, upon removal, as the conveying member is drawn out from the opening, the projecting pieces elastically deform and return to the position for reliably closing the opening. As a result, it is possible to automatically prevent waste developer from spilling out or scattering without the necessity of a special operation when the waste developer collecting container is detached.

In the present invention, since the elastic element has an essentially flat sheet-like configuration, cut by radial slits from the rim to the center, so that a plurality of projecting pieces attached at the rim are formed in the center, it is possible to form a plurality of projecting pieces by a relatively simple process as just cutting, with a low work load because the projecting pieces need not be individually formed by resin molding.

In the present invention, the first seal and the second seal are joined to each other at their respective ends opposite to their respective openings with respect to the planar direction, and the third adhesive and the elastic element are laminated on the second seal, and upon replacement of the waste developer collecting container, the second seal is peeled off, together with the third adhesive and the elastic element, from the collecting port side, and the peeled second seal and the elastic element are made to stick to the wall surface of the collecting container. It is therefore possible to reliably prevent the waste developer that is adhering to the peeled elastic element etc., from scattering.

DESCRIPTION OF THE PREFERRED EMBODIMENTS

The preferred embodiments of the present invention will hereinafter be described with reference to the accompanying drawings.

Figure 1:
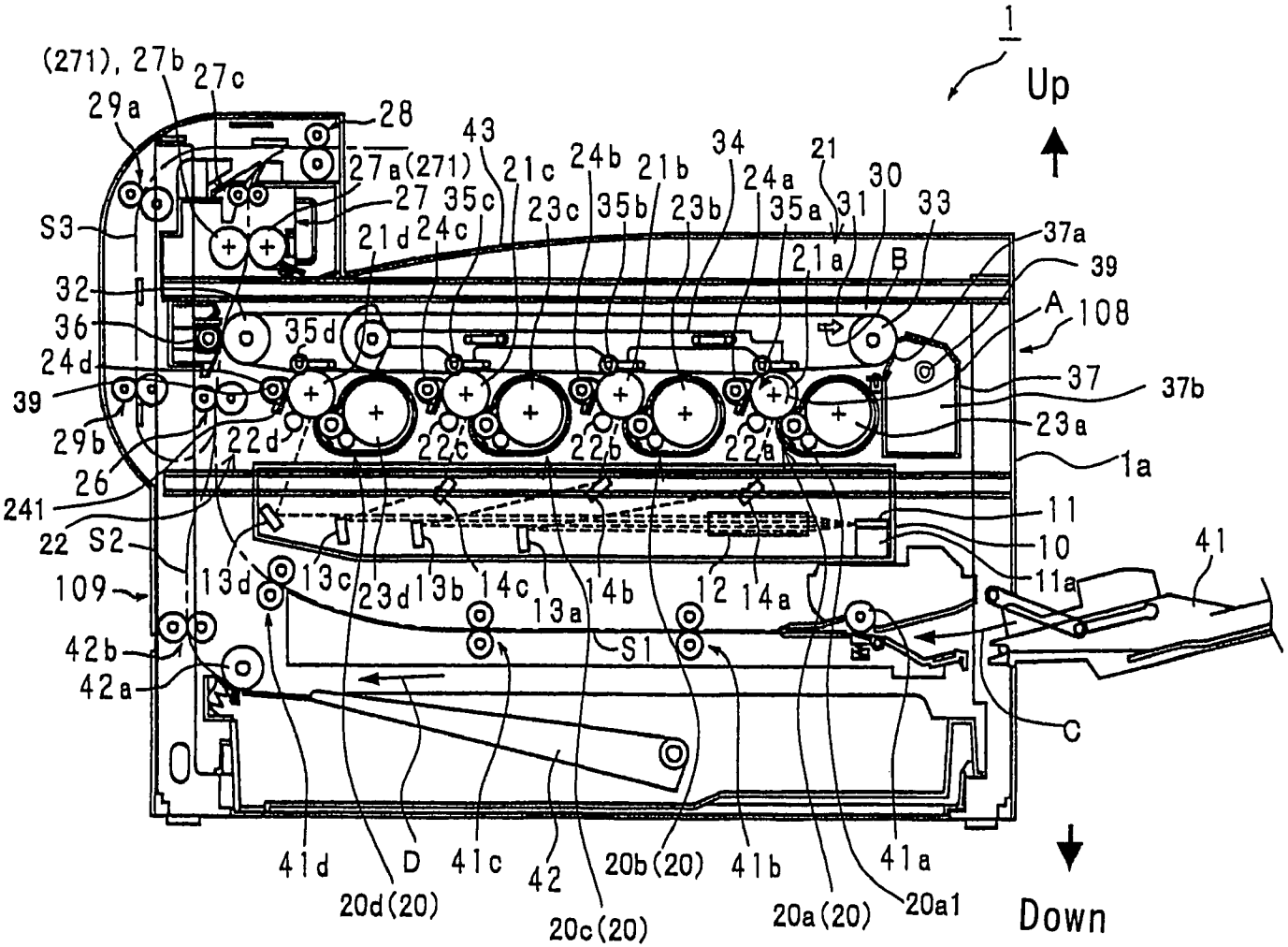
FIG. 1 is an illustrative sectional diagram, viewed from the rear, showing the overall configuration of a color image forming apparatus according to the embodiment of the present invention.

FIG. 1 shows one example of the embodied mode of the present invention, and is an illustrative diagram (sectional view from the front) showing the overall configuration of a color image forming apparatus (corresponding to the "image forming apparatus") according to one embodiment. FIGS. 2 to 6 are illustrative views showing a waste toner collecting container (corresponding to the "waste developer collecting container") 38 and an air sealing member 40, in a color image forming apparatus 1.

Figure 2:
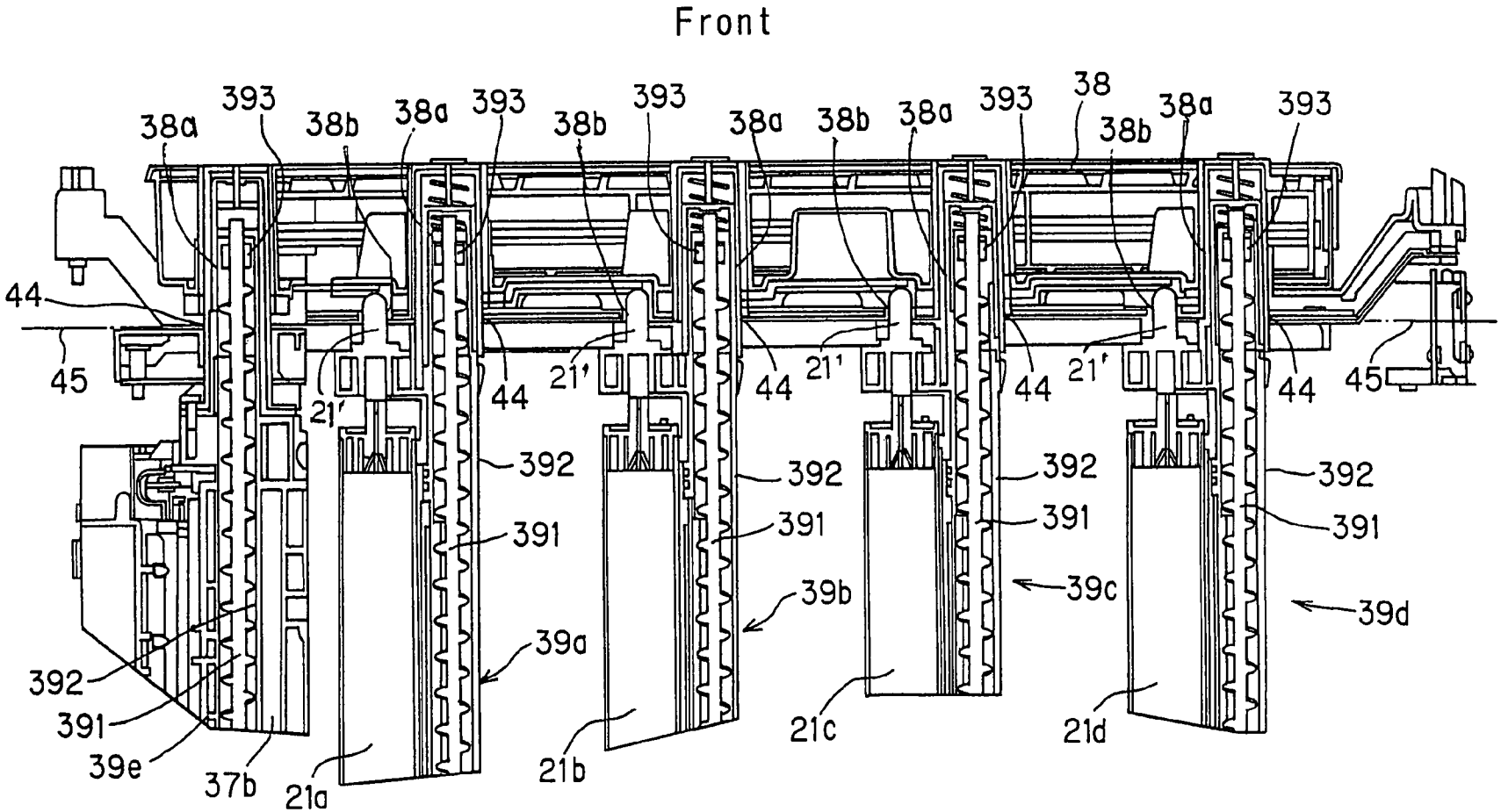
FIG. 2 is a sectional top view, cut by the plane that includes the axes of toner conveying members of cleaner units and a transfer belt cleaning unit, explaining the attachment of a waste toner collecting container in a color image forming apparatus.

As shown in FIGS. 1 and 2, the waste developer collecting container (waste toner collecting container 38) of the image forming apparatus according to the present embodiment stores developer particles of the developer (toner) used for developing images of information formed on an electrostatic latent image bearing member (photoreceptor drum 21) which have not been transferred to recording mediums (recording paper) and have been collected as waste developer (waste toner) This waste developer collecting container is removable from the image forming apparatus (color image forming apparatus 1), and is constructed such that an air sealing member 40 is disposed at the coupling (44) between the waste developer collecting container and a conveying member (toner conveying member 39) for convening the collected waste developer into the waste developer collecting container through a collecting port (38*a*) to prevent the waste developer from spilling out at the coupling when the waste toner is conveyed and to seal the collecting port so that no waste developer will spill out from the waste developer collecting container which has been removed for replacement after the waste developer which has been collected and conveyed therein by the conveying member has reached the predetermined amount.

Next, color image forming apparatus 1 provided with waste toner collecting container 38 according to the present embodiment will be described in detail.

As shown in FIG. 1, a color image forming apparatus 1 of the present embodiment includes: a plurality of image forming units or namely, process printing units 20 (20*a*, 20*b*, 20*c* and 20*d*) each having a photoreceptor drum 21 (21*a*, 21*b*, 21*c* and 21*d*) for supporting a developer image (which will be referred to as "toner image" hereinbelow) formed with a toner corresponding to the color of color-separated image information; a transfer belt 31 as an intermediate transfer medium to which a multiple number of toner images are transferred in layers; and a transfer roller 36 as a constituent of a transfer station for transferring the toner images that have been transferred in layers on the transfer belt 31, all at once, to recording paper, and is constructed such that the plurality of process printing units 20*a*, 20*b*, 20*c* and 20*d* are arranged parallel to each other along the transfer belt 31.

Here, concerning the positional relationship between the color image forming apparatus 1 and the operator in the present embodiment, the operator is supposed to stand at the near side of the color image forming apparatus 1 shown in FIG. 1.

In other words, the control side is located at the near side of color image forming apparatus 1, and the left and right sides of FIG. 1, as viewed, are the same as those when the operator faces the control side.

In the following description, the front side (F-side) refers to the operator side and the rear side (R-side) refers to the backside of color image forming apparatus 1, or the side not shown by FIG. 1.

To begin with, the overall configuration of color image forming apparatus 1 will be described.

As shown in FIG. 1, color image forming apparatus 1 according to the present embodiment is a so-called digital color printer which, by separating color image information into images of individual colors and forming each of the separated color images, outputs a full-color image.

This color image forming apparatus 1 is mainly composed of an image forming portion 108 at the top and a paper feed portion 109 at the bottom, and forms multi-color images or monochrome images on recording mediums (sheets made of a predetermined material and having predetermined dimensions and thickness) in accordance with a print job sent from an information processor (not illustrated) such as a personal computer etc., externally connected. Here, as recording mediums, other than sheets of paper, resin sheets and metallic sheets may be also used as necessary.

Image forming portion 108 forms multi-color images based on electrophotography with yellow (Y), magenta (M), cyan (C) and black (K) colors, and is mainly composed of an exposure unit 10, process printing units (also called "image stations") 20 as image forming units, a fixing unit 27, a transfer belt unit 30 having a transfer belt 31 as an intermediate transfer medium, and a transfer belt cleaning unit 37 as an intermediate transfer medium cleaning device.

Describing the overall arrangement of image forming portion 108, fixing unit 27 is disposed on the top at one end side of a housing 1*a* of color image forming apparatus 1, transfer belt unit 30 is extended under the fixing unit 27 from the one end side to the other end side of housing 1*a*, process printing units 20 are disposed under the transfer belt unit 30, and exposure unit 10 is disposed under the process printing units 20.

Further, transfer belt cleaning unit 37 is arranged on the other side end of transfer belt unit 30. Also, a paper output tray 43 is arranged contiguous to fixing unit 27, over image forming portion 108.

Paper feed portion 109 is arranged under the image forming portion 108.

In the present embodiment, as process printing units 20, four process printing units 20*a*, 20*b*, 20*c* and 20*d*, corresponding to individual colors, i.e., yellow (Y), magenta (M), cyan (C) and black (K), are arranged in the order mentioned in the direction in which transfer belt 31 travels. This order of the colors contributes to realizing lamination of toner images on transfer belt 31 without color blurring.

The process printing unit 20*a* for the color whose toner image, among all the toner images to be transferred to transfer belt 31, is transferred to transfer belt 31 first, or in other words, the process printing unit 20*a* which is located at a position most distant from transfer roller 36, holds a toner of yellow (Y) color so as to form a yellow toner image first on transfer belt 31.

These process printing units 20*a*, 20*b*, 20*c* and 20*d* are arranged in parallel to each other, in the approximately horizontal direction (in the right-to-left direction in the drawing) in housing 1*a*, and include respective photoreceptor drums 21*a*, 21*b*, 21*c* and 21*d* as the image support for each individual associated color, respective charging devices 22*a*, 22*b*, 22*c* and 22*d* for charging the photoreceptor drums 21*a*, 21*b*, 21*c* and 21*d*, respective developing devices 23*a*, 23*b*, 23*c* and 23*d* and respective cleaner units 24*a*, 24*b*, 24*c* and 24*d* and other components.

Here, the symbol a, b, c, and d added to the constituents of every color show correspondence to yellow (Y), magenta (M), cyan (C) and black (K), respectively. In the description hereinbelow, however, the constituents provided for each color are generally referred to as photoreceptor drum 21, charging device 22, developing device 23, and cleaner unit 24, except in the case where a constituent corresponding to a specific color needs to be specified.

Photoreceptor drums 21 are arranged (mounted) in the upper part of this color image forming apparatus 1.

Each photoreceptor drum 21 is arranged so that part of its outer peripheral surface comes into contact with the surface of transfer belt 31 while charging device 22 as an electric field generator, developing device 23 and cleaner unit 24 are arranged along, and close to, the outer peripheral surface of the drum.

Charging device 22 is a charging means for charging the surface of photoreceptor drum 21 at a predetermined potential. Here, a contact roller type charger is used as shown in FIG. 1. This charging device 22 is arranged, at a position on the approximately opposite side across photoreceptor drum 21, from transfer belt unit 30, and in contact with the outer peripheral surface of photoreceptor drum 21.

Though in the present embodiment a roller type charger is used as charging device 22, a brush type charger, discharging type charger may be used in place of the roller type charger.

Exposure unit 10 has the function of creating an electrostatic latent image on the photoreceptor drum 21 surface, by irradiating the photoreceptor drum 21 of each color having a uniform surface potential charged by charging device 22, with a laser beam in accordance with the image data of the corresponding color printing.

This exposure unit 10 is mainly composed of a laser scanning unit (LSU) 11 having a laser illuminator 11*a*, a polygon mirror 12 and reflection mirrors 13*a*, 13*b*, 13*c*, 13*d*, 14*a*, 14*b* and 14*c* for reflecting the laser beam for different colors.

The laser beam emitted from laser illuminator 11*a* is separated into components for different colors, by polygon mirror 12, so that the separated components of light are reflected by respective reflection mirrors 13*a* to 13*d* and 14*a* to 14*c* to illuminate the corresponding photoreceptor drums 21 of every color.

Here, as to laser scanning unit 11, a writing head made up of an array of light emitting devices such as EL (electro luminescence), LED (light emitting diode) and others, can also be used instead of laser illuminator 11*a*.

Developing device 23 is to supply a toner of yellow (Y), magenta (M), cyan (C) or black (K) color to the static latent image formed on the peripheral surface of the photoreceptor drum 21 by exposure unit 10 to visualize it.

These toners of yellow (Y), magenta (M), cyan (C) and black (K) colors are held by respective developing device 23, and each developing device 23 is arranged on the downstream side of charging device 22 with respect to the rotational direction of the photoreceptor drum (in the direction of arrow A in the drawing).

Cleaner unit 24 is to remove and collect the toner remaining on the surface of photoreceptor drum 21 after the toner image developed, on the photoreceptor drum 21 surface by developing device 23 has been transferred to transfer belt 31. This cleaner unit 24 is arranged on the downstream side of transfer belt 31 and on the upstream side of charging device 22 with respect to the rotational direction of the photoreceptor drum.

Further, cleaner unit 24 has a cleaning blade 241 and is configured so that the cleaning blade 241 is positioned in abutment with the outer peripheral surface of photoreceptor 21 so as to scrape and collect the leftover toner off the photoreceptor drum 21. The collected toner is conveyed as waste toner to waste toner collecting container 38 by toner conveying member 39 described below.

A reference numeral 391 in the drawing designates a conveying screw which is provided for toner conveying member 39 to convey the toner in a feedscrew manner.

Transfer belt unit 30 is disposed along photoreceptor drums 21 and is mainly composed of transfer belt 31, a transfer belt drive roller 32, a transfer belt driven roller 33, a transfer belt tension mechanism 34, intermediate transfer rollers 35*a*, 35*b*, 35*c* and 35*d*.

In the following description, all the intermediate transfer rollers 35*a*, 35*b*, 35*c* and 35*d* will be referred to as intermediate transfer rollers 35 when general mention is made.

In transfer belt unit 30, transfer belt 31 is tensioned by transfer belt drive roller 32, transfer belt driven roller 33, transfer belt tension mechanism 34 and intermediate transfer rollers 35 so that its surface comes into contact with the outer peripheral surfaces of photoreceptor drums 21, and is adapted to move in the auxiliary scan direction (in the direction of arrow B in the drawing) by a driving force of the transfer belt drive roller 32.

In this arrangement, transfer belt unit 30 provides the function of forming a color toner image (multi color toner image) on the transfer belt by transferring the toner images of every color formed on photoreceptor drums 21, one over another, to transfer belt 31.

Transfer belt 31 is formed of an endless film of about 100 μm to 150 μm thick. Transfer belt 31 is made from polyimide, polycarbonate or the like.

Transfer belt drive roller 32 is disposed at one end side of housing 1*a*, and is wound with transfer belt 31 so as to drive the transfer belt 31 by applying a driving force whilst nipping and pressing the transfer belt 31 and a recording sheet together between itself and transfer roller 36 to convey the recording sheet.

Transfer belt driven roller 33 is disposed on the other end side of housing 1*a*, so as to suspend and tension the transfer belt 31 approximately horizontally from the one end side to the other end side of housing 1*a*, in cooperation with transfer belt drive roller 32.

Transferring of toner image from the photoreceptor drums 21 to the transfer belt 31 is carried out through intermediate transfer roller 35 which is contacted to the interior surface of transfer belt.

Intermediate transfer rollers 35 are arranged in the interior space of transfer belt 31 wound between transfer belt drive roller 32 and transfer belt driven roller 33 so as to abut the inner surface of transfer belt 31 and press its outer peripheral surface against the outer peripheral surfaces of the photoreceptor drums 21.

Further, intermediate transfer roller 35 is formed of a metal (e.g., stainless steel) shaft having a diameter of 8 to 10 mm as the base member and a conductive elastic material such as EPDM, foamed urethane etc., coated on the outer peripheral surface of the metal shaft.

Each of the thus formed intermediate transfer rollers 35 is applied with a high-voltage transfer bias for transferring the toner image formed on photoreceptor drum 21 to transfer belt 31, i.e., a high voltage of a polarity (+) opposite to the polarity (−) of the electrostatic charge on the toner, so as to apply a uniform high voltage from the elastic material to transfer belt 31.

Though in the present embodiment, roller-shaped electrodes, such as intermediate transfer rollers, are employed as the transfer electrodes, other than these a brush type electrode may be used.

The visualized toner images (electrostatic images) formed on the photoreceptor drums 21 corresponding to every color are transferred one over another on transfer belt 31, reproducing the image information input to the apparatus. The thus formed laminated image information is transferred to the recording sheet by transfer roller 36 disposed at the contact point of transfer belt 31 with the paper.

Detailedly, transfer roller 36 as a constituent of the transfer station is arranged opposing transfer belt drive roller 32 at approximately the same level and in parallel thereto and pressing against the transfer belt 31 wound on the transfer belt drive roller 32, forming a predetermined nip therewith while being applied with a high voltage of a polarity (+) opposite to the polarity (−) of the static charge on the toner, for transferring the multi-color toner image formed on the transfer belt 31 to the recording paper.

In order to produce a constant nip between transfer belt 31 and transfer roller 36, either transfer belt drive roller 32 or transfer roller 36 is formed of a hard material such as metal or the like while the other roller is formed of a soft material such as elastic rubber, foamed resin, etc.

A registration roller 26 is provided under transfer belt drive roller 32 and transfer roller 36. This registration roller 26 is configured so as to set the front end of a recording sheet fed from paper feed portion 109 aligned with the leading end of the toner image on transfer belt 31 and deliver the sheet toward the transfer roller 36 side.

Since the toner adhering to transfer belt 31 as the belt comes in contact with photoreceptor drums 21, or the toner which has not been transferred to the recording sheet by transfer roller 36 and remains on transfer belt 31, would cause contamination of color toners at the next operation, it is removed and collected by transfer belt cleaning unit 37.

Transfer belt cleaning unit 37 includes: a cleaning blade 37*a,* as a cleaning element, located near transfer belt driven roller 33 and arranged so as to abut (come into sliding contact with) transfer belt 31; a box-like toner collector 37*b* for temporarily holding the waste toner, left over on and scraped from transfer belt 31 by the cleaning blade 37*a;* and a toner conveying member 39 of a screw conveyor type for sending the waste toner from toner collector 37*b* to waste toner collecting container 38.

Also, transfer belt cleaning unit 37 is located near process printing unit 20*a,* on the upstream side of the process printing unit 20*a* with respect to the moving direction of transfer belt 31. Further, transfer belt 31 is supported from its interior side by transfer belt driven roller 33, at the portion where cleaning blade 37*a* comes into contact with the outer surface of transfer belt 31.

Further, toner conveying member 39, which will be detailed later, is arranged to establish connection from toner collector 37*b* in transfer belt cleaning unit 37 to waste toner collecting container 38 so as to convey waste toner.

Fixing unit 27 includes: as shown in FIG. 1, paired fixing rollers 271 consisting of a heat roller 27*a* and a pressing roller 27*b;* and a conveying roller 27*c* above the fixing rollers 271. A recording sheet is input from below fixing rollers 271 and output to above conveying roller 27*c*.

A paper discharge roller 28 is arranged above fixing unit 27, so that the recording sheet conveyed from conveying roller 27*c* is discharged by the paper discharge roller 28 to paper output tray 43.

Referring to the fixing of a toner image by fixing unit 27, a heating device (not shown) such as a heater lamp or the like, provided inside or close to heat roller 27*a* is controlled based on the detected value from a temperature detector (not shown) so as to keep the heat roller 27*a* at a predetermined temperature (fixing temperature) while the recording sheet with a toner image transferred thereon is heated and pressed between heat roller 27*a* and pressing roller 27*b* as it is being conveyed and rolled, so that the toner image is thermally fused onto the recording sheet.

A duplex printing paper path S3 for double-sided printing is constructed adjacent to fixing unit 27, from the rear of fixing unit 27 downward to the vicinity of paper feed portion 109. Conveying rollers 29*a* and 29*b* are arranged at the top, and bottom and along the duplex printing paper path S3, so that the recording sheet is delivered again toward transfer roller 36 with its face inverted.

Specifically, conveying roller 29*a* is disposed at the rear of fixing unit 27 and conveying roller 29*b* is located below conveying roller 29*a* with respect to the top and bottom direction and at approximately the same level as registration roller 26.

Referring to FIGS. 1 to 6, the waste toner collecting container 38 and toner conveying members 39 provided for cleaner units 24 and transfer belt cleaning unit 37 will be described in detail.

Figure 3:
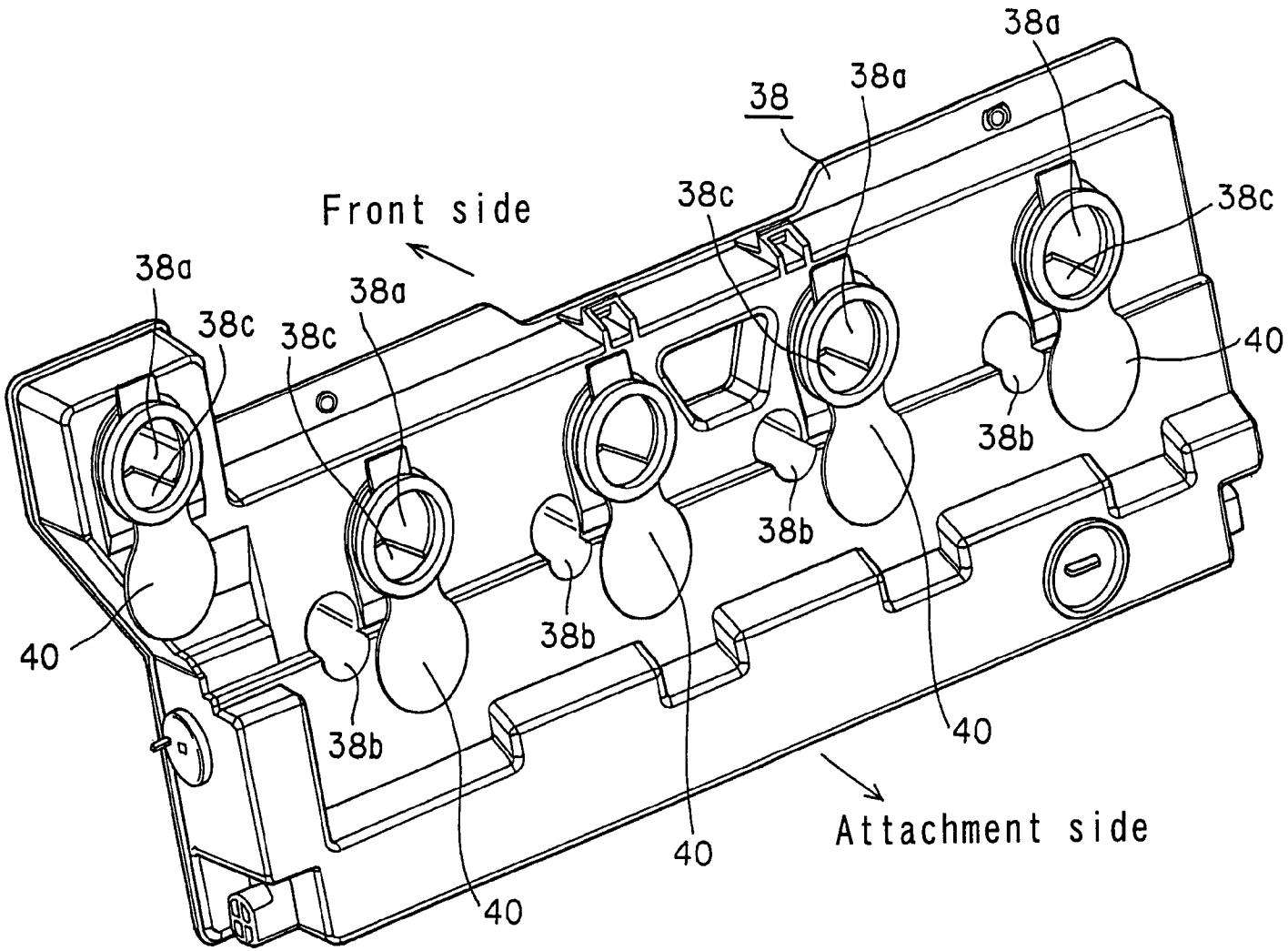
FIG. 3 is a perspective view showing a waste toner collecting container, viewed from the side to be attached (the interior side)
Figure 4:
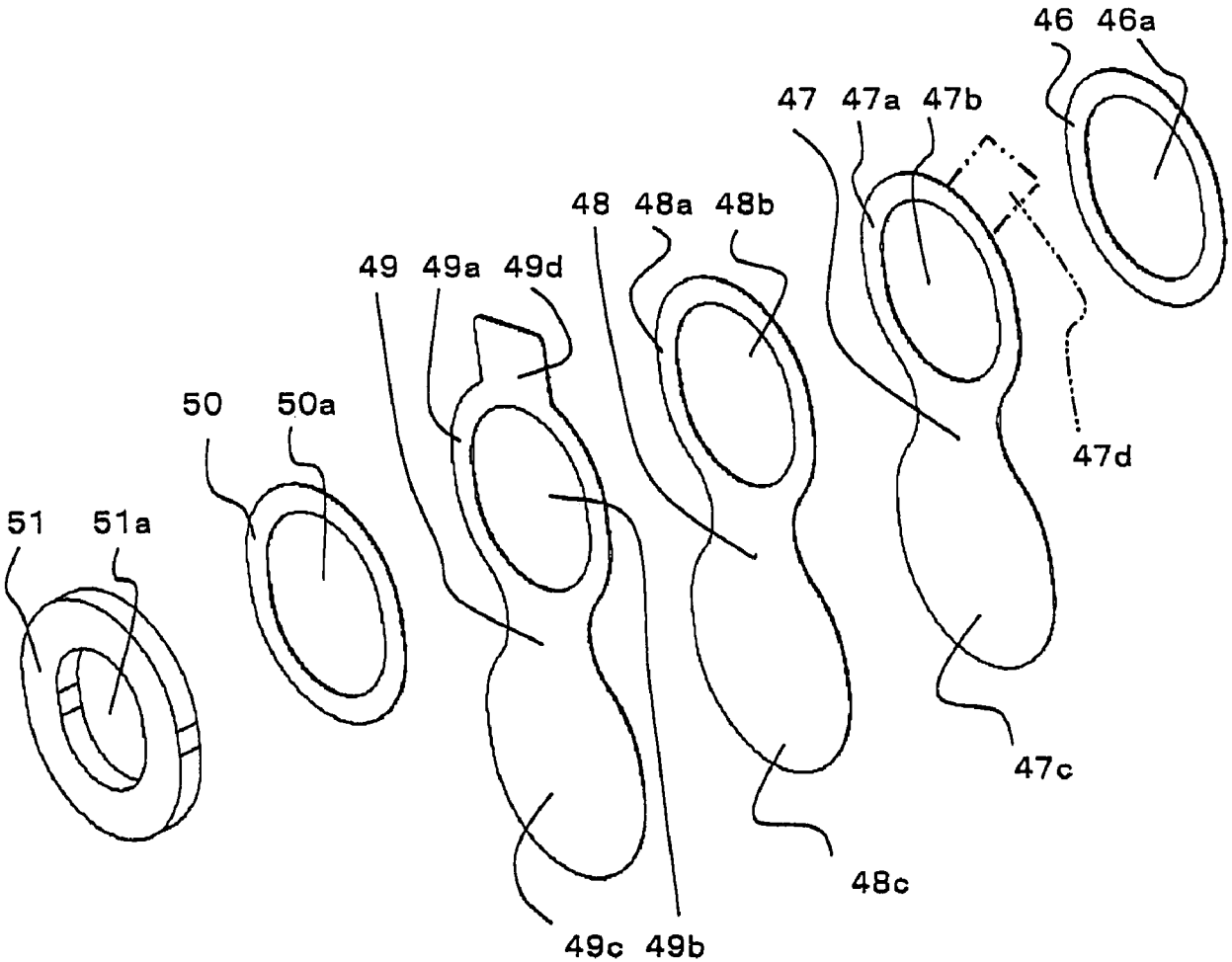
FIG. 4 is an exploded perspective view showing an air sealing member.
Figure 5:
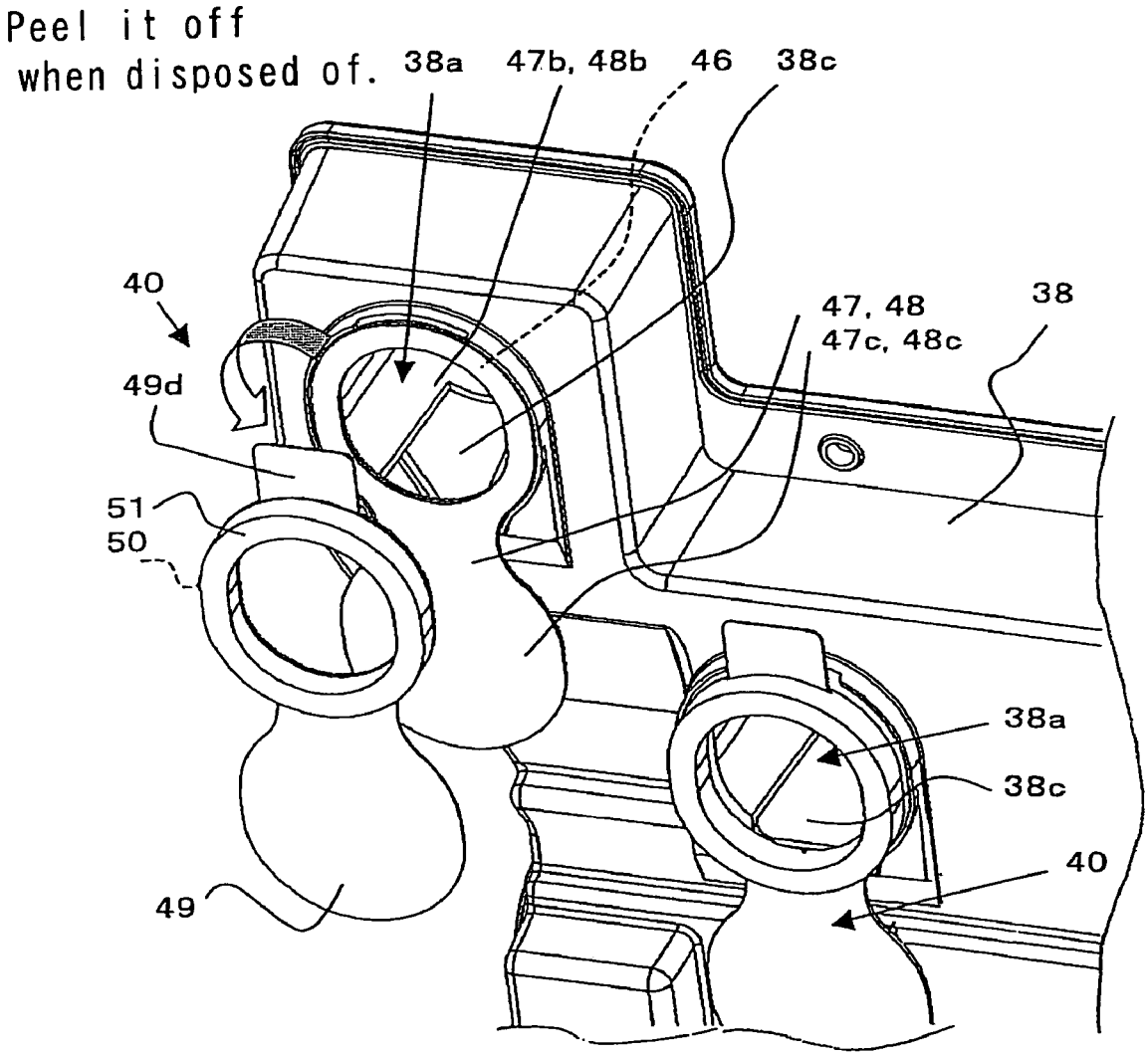
FIG. 5 is an illustrative view showing a state where part of an air sealing member is peeled off from a waste toner collecting container which is separated from a color image forming apparatus.
Figure 6:
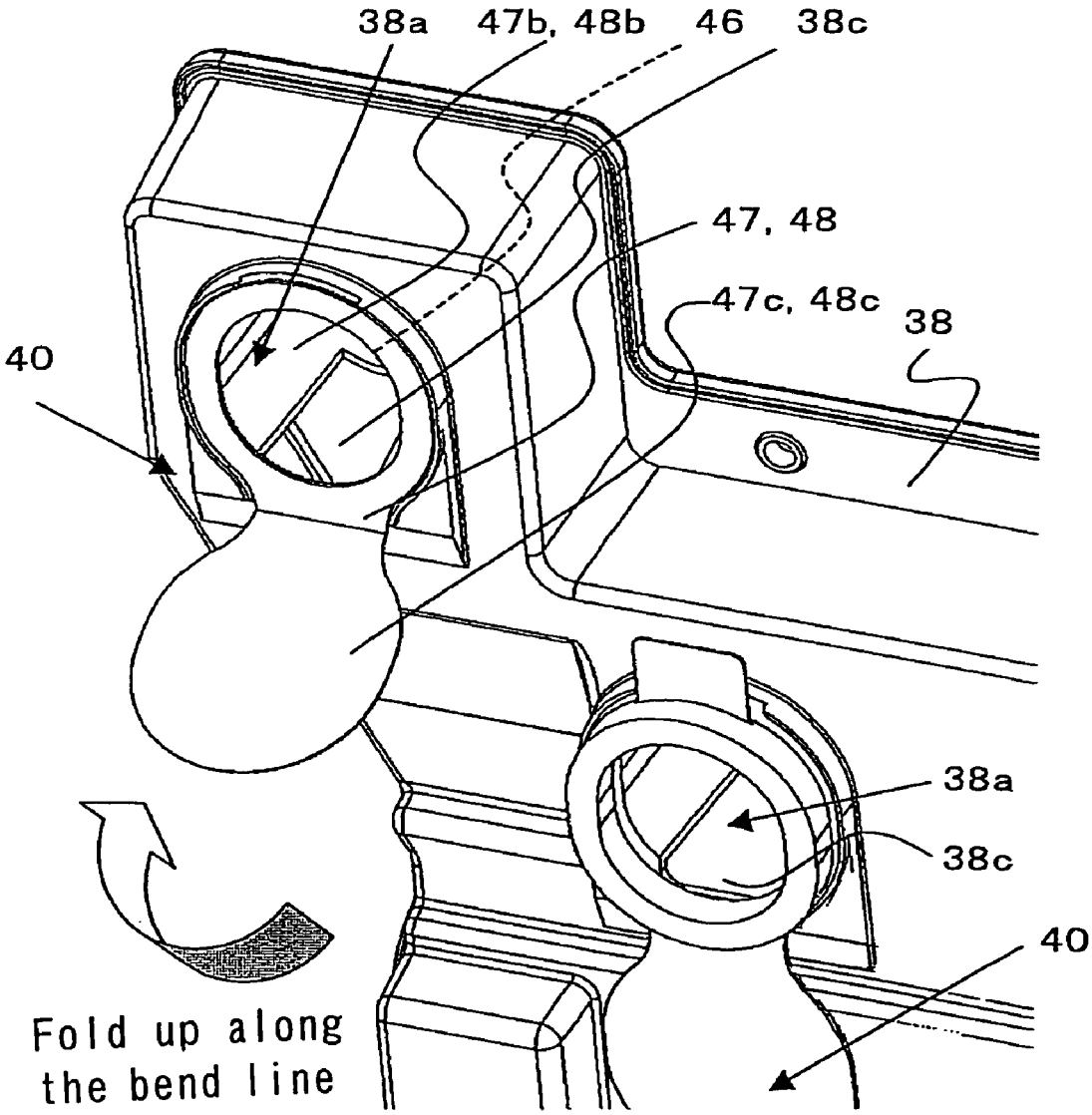
FIG. 6 is an illustrative view showing a state where a collection port is confined by applying an air sealing member.

FIG. 2 is a sectional top view, cut by the plane that includes the axes of toner conveying members 39 of cleaner units 24 and transfer belt cleaning unit 37, explaining the attachment of waste toner collecting container 38 in color image forming apparatus 1. FIG. 3 is a perspective view showing waste toner collecting container 38, viewed from the side to be attached (the interior side). FIG. 4 is an exploded perspective view showing air sealing member 40. FIG. 5 is an illustrative view showing a state where part of air sealing member 40 is peeled off from waste toner collecting container 38 which is separated from color image forming apparatus 1. FIG. 6 is an illustrative view showing a state where a collecting port 38*a* is confined by applying air sealing member 40.

Waste toner collecting container 38 is attached to the front side of color image forming apparatus 1 as one faces FIG. 1.

The waste toner collecting container 38 and toner conveying member 39 for conveying the collected waste toner into the waste toner collecting container 38 through collecting port 38*a,* accommodates conveying screw 391 which has a continuous spiral vane formed on the outer periphery of a rotational axis and incorporated in a cylindrical conveyor case 392.

In this arrangement, as conveying screw 391 is turned by an unillustrated driving source, the waste toner residing between the spiral vane of conveying screw 391 and the interior wall surface of conveyor case 392 is moved in a direction away from photoreceptor drum 21 or toner collector 37*b* and brought into waste toner collecting container 38. As shown in FIG. 2, toner conveying member 39 is provided for each cleaner unit 24 (24*a,* 24*b,* 24*c* and 24*d*) of processing printing unit 20, and these are assigned with reference numerals 39*a* to 39*d,* correspondingly. Further, another toner conveying member is provided for transfer belt cleaning unit 37 and is designated at 39*e*.

For the conveying member 39 provided for each cleaner unit 24, an unillustrated opening is formed in conveyor case 392 so that waste toner scraped from photoreceptor drum 21 by cleaning blade 241 is input therethrough.

Also, for the conveying member 39 provided for transfer belt cleaning unit 37, an unillustrated opening is formed in conveyor case 392 so that waste toner once stored in toner collector 37*b* is input therethrough.

Toner conveying member 39 has a rod-like portion that is projected to the front of color image forming apparatus 1 beyond the attachment face, designated at 45, for waste toner collecting container 38. This projected portion is inserted through collecting port 38*a* into waste toner collecting container 38 when it is mounted to color image forming apparatus 1.

As shown in FIG. 3, waste toner collecting container 38 has a, roughly, flat box configuration as a whole and is formed with collecting ports 38*a* that open correspondingly to cleaner units 24 and transfer belt cleaning unit 37. Further, a bearing hole 38*b* that will receive and support the shaft end of photoreceptor drum 21 is formed at a slightly lower position adjacent to (on the left side, in the top view in this embodiment) collecting port 38*a* for each cleaner unit 24. A bullet shaped shaft end, shown and designated at 21' in FIG. 2, of photoreceptor drum 21 is fitted into corresponding bearing hole 38*b,* to thereby reliably position the photoreceptor drum 21.

In each toner conveying member 39, a discharge hole 393 through which waste toner drops, is formed on the bottom side of the projected portion of conveyor case 392, which is inserted into collecting port 38*a* of waste toner collecting container 38. In waste toner collecting container 38, the interior of collecting port 38*a* is defined with an inner peripheral surface of an approximately cylindrical form, so that the projected portion of toner conveying member 39 fitted into collecting port 38*a* is supported by this inner peripheral surface. Thus, toner conveying members 39 can be positioned by waste toner collecting container 38.

Formed at a position corresponding to discharge hole 393 of the inserted conveyor case 392, in the bottom of this inner peripheral surface, is an input hole 38*c* that communicates with the interior of waste toner collecting container 38. Waste toner conveyed by toner conveying member 39, passing through the discharge hole 393 and input hole 38*c*, is collected and stored in waste toner collecting container 38.

Air sealing member 40 is disposed at each coupling 44 between the periphery of collecting port 38*a* and toner conveying member 39, located at the attachment face 45 of color image forming apparatus 1, to which the waste toner collecting container 38 is attached.

This air sealing member 40 prevents waste toner from seeping out through the coupling 44 when waste toner is conveyed and seals collecting port 38*a* so that no waste toner will flow out from waste toner collecting container 38 which has been removed for replacement after the waste toner collected and conveyed therein by the conveying member 39 has reached the predetermined amount.

According to this waste toner collecting container 38 of color image forming apparatus 1, when waste toner collecting container 38 is being mounted to color image forming apparatus 1, sealing assemblies 40 provide a reliable sealing function of preventing waste toner from leaking through couplings 44. Further, when waste toner collecting container 38 has been removed for replacement, the sealing assemblies 40 are used to seal collecting ports 38*a* of the waste toner collecting container 38. Accordingly, it is possible to reliably prevent waste toner from spilling out from the collecting container 38 when the collecting container 38 is handled or transported.

As a result, it is possible to reuse waste toner collecting container 38 and also improve the sealing performance for reliably preventing the waste toner from scattering while the container is mounted and being used and the hermetic sealability for reliably preventing the waste toner from spilling out from waste toner collecting container 38 when it has been removed. This configuration also facilitates simple sealing work.

In the present embodiment, the waste toner collecting container 38 is intended to be removed for replacement when the container collects a predetermined amount of waste toner, for example, when the container is full. However, it is also possible to use other predetermined indicators to determine the timing of replacement other than the fact that the container is full. For example, the timing of replacement may be determined based on the usage period of color image forming apparatus 1.

Further, waste toner collecting container 38 is adapted to be reused by providing new sealing assemblies 40 around collecting ports 38*a* of waste toner collecting container 38.

This facilitates recycling of the waste toner collecting container 38.

The air sealing member 40 is composed of sealing material, adhesives and a foaming. Accordingly, it is possible to attain the aforementioned sealing performance and hermetic sealability with a simple configuration.

In the embodiment, the air sealing member 40 is composed of, as separately shown in FIG. 4, a first adhesive 46, first seal 47, second adhesive 48, second seal 49, third adhesive 50 and foaming 51, all having openings (46*a*, 47*b*, 48*b*, 49*b*, 50*a* and 51*a*), respectively, corresponding to the aforementioned collecting port 38*a*, and laminated in the order mentioned, from the waste toner collecting container 38 side to the opposite side in the coupling 44.

In addition, in the embodiment, the lamination of first adhesive 46, first seal 47, second adhesive 48, second seal 49 and third adhesive 50 in the air sealing member 40 is formed in a flat sheet-like configuration having greater planar dimensions compared to the thickness, and foaming 51 has a projected configuration having a thickness along the axis of the opening so as to enclose the opening.

First adhesive 46 and third adhesive 50 are annular, having circular openings 46*a* and 50*a* therein, respectively, and have a double-sided tape structure having adhesive layers on both sides. Second adhesive 48 also has a similar double-sided tape structure.

First seal 47 has an approximately figure-eight-shaped configuration, made of two circles having almost the same diameter connected to each other, one of the circles, designated at 47*a*, having an annular shape with a circular opening 47*b*. The other circular portion 47*c* has no opening and is sized so that the circular portion 47*c* is able to completely cover the circular opening 47*b* of circular portion 47*a*.

First seal 47 is preferably formed of a thin film resin of polyethylene terephthalate (PET) etc., or a mylar sheet. Second seal 49 is also made from the same material.

Second adhesive 48 has the same form as first seal 47, or is made up of a circular portion 48*a*, a circular opening 48*b* and a circular portion 48*c*.

Second seal 49 generally has the same shape as first seal 47, or is made up of a circular portion 49*a* having a circular opening 49*b*, another circular portion 49*c*, and a rectangular projected tab 49*d* extended in the same plane from circular portion 49*a* and at the end of the full length of the element as a whole. This projected tab 49*d* may have any shape and size as long as it can be pulled by user's thumb and finger. Since projected tab 49*d* is formed at the end of the full length of second seal 49, this position is preferable for its peeling. However, the projected tab may be formed at a position deviated sidewards from the end of the length of the element as a whole.

Additionally, the first seal and second seal may have other configurations than those shown in FIG. 4, that is, they may have a rectangular or polygonal shape. The first seal as well as the second seal may be formed of two different, joined, shapes instead of being made of two similar, joined, shapes. Concerning the configurations of circular openings 46*a*, 47*b*, 48*b*, 49*b*, 50*a* and 51*a*, because conveyor case 39*b* of toner conveying member 39 has a circular cross-section it is preferred that they have circular shapes so as to come into close contact therewith. However, if the toner conveying member has another contour, the opening should also be formed in conformity with that shape.

Foaming 51 has an annular shape having a circular opening 51*a* and is formed thicker than any of first adhesive 46, first seal 47, second adhesive 48, second seal 49 and third adhesive 50.

Foaming 51 is made of continuous foam such as so-called sponge or the like. Use of such continuous foam for the foaming makes it possible for its continuous pores created by foaming to catch waste toner particles and stop waste toner from spilling out, thus achieving reliable prevention against waste toner leakage and scattering.

According to the air sealing member 40 having the above configuration, it is possible to create a laminated structure which can set up desired hermitic sealability and it is also possible to peel off the seal in an easy manner, owing to provision of the adhesive.

Air sealing member 40 attached to waste toner collecting container 38 is disposed at each coupling 44 with toner conveying member 39 inserted through the openings (46*a*, 47*b*, 48*b*, 49*b*, 50*a* and 51*a*).

FIG. 5 shows a state where part of air sealing member 40 is peeled and FIG. 6 shows a state where air sealing member 40 is about to seal.

In waste toner collecting container 38, each collecting port 38*a* of the waste toner collecting container 38 is sealed by the steps of peeling the second seal 49 from the second adhesive 48 of the air sealing member 40 disposed around the collecting port 38*a,* as shown in FIG. 5, after disengagement of waste toner collecting container 38 from the toner conveying member 39 when the waste toner reaches the predetermined amount; and folding up the part other than opening 47*b* of first seal 47, i.e., the part 47*c,* toward the opening 47*b,* as shown in FIG. 6.

By this arrangement, it is possible to definitely seal off the waste toner collecting container 38 when it has been removed from color image forming apparatus 1. Detailedly, in sealing each collecting port 38*a* after waste toner collecting container 38 is removed, when the second seal 49 of the air sealing member is peeled from second adhesive 48, the second adhesive is left over on first seal 47 after peeling. As the first seal 47 is folded up, opposing areas of second adhesive 48 robustly bond to each other. Thus it is possible to concisely and reliably seal collecting port 38*a* by first seal 47 without the necessity of applying any extra adhesive etc.

In the above configuration, it is possible to reuse waste toner collecting container 38 by removing the entire piece of each air sealing member 40 that is sealing collecting port 38*a* of the waste toner collecting container 38, or removing part of each air sealing member 40 inclusive of first seal 47, and then placing and applying new sealing assemblies 40 to waste toner collecting container 38.

The embodiment of waste toner collecting container 38 is that in which recycling is made possible by removing part of each air sealing member 40 inclusive of first seal 47 and then placing and applying new sealing assemblies 40 to waste toner collecting container 38.

With this configuration, as the air sealing member inclusive of first seal 47 is peeled off, first adhesive 46 remains on the waste toner collecting container 38 side. Accordingly, when new air sealing member 40 is to be applied, one with its first adhesive 46 absent may be used for applying, it is therefore possible to simplify the structure of air sealing member 40 for recycling the waste toner collecting container 38. Also, this configuration will save the effort of removing first adhesive 46, hence is able to simplify the work for recycling the waste toner collecting container.

In a case where the entire piece of air sealing member 40 is peeled off, since new air sealing member 40 is applied by means of first adhesive 46, this configuration is advantageous in attaching the air sealing member 40 with a strong bonding force of the fresh first adhesive 46.

To allow for easy peeling when air sealing member 40 is totally removed, a projected tab 47*d* which facilitates grabbing by the user is preferably provided for first seal 47 as shown by two-dot chain line in FIG. 4. In this case, in order not to make peeling of second seal 49 troublesome, the projected tab 47*d* of first seal 47 should be formed at a different angular position from that of projected tab 49*d*. This arrangement makes it possible to avoid first seal 47 interfering and allow for easy peeling when second seal 49 is peeled off.

Next, the configuration of paper feed portion 109 will be described.

Paper feed portion 109 includes a manual feed tray 41 and paper feed cassette 42 for holding recording sheets to be used for image forming, and is adapted to deliver recording sheets, one by one, from manual feed tray 41 or paper feed cassette 42 to image forming portion 108.

As shown in FIG. 1, manual feed tray 41 is arranged at one side end (on the right side in the drawing) of housing 1*a* of color image forming apparatus 1 so that it can be unfolded out the side when used and folded up to the one end side when unused. This tray delivers paper, one by one, into the housing 1*a* of color image forming apparatus 1 when the user places a few recording sheets (necessary number of sheets) of a desired type.

Arranged on the downstream side with respect to the paper feed direction (the direction of arrow C in the drawing) of recording sheet by manual feed tray 41, inside housing 1*a* of color image forming apparatus 1, is a pickup roller 41*a* below exposure unit 10. Conveying rollers 41*b,* 41*c* and 41*d* are also disposed at approximately the same level along the path downstream with respect to the paper feed direction.

Pickup roller 41*a* touches one edge part of the surface of the recording sheet that is fed from manual feed tray 41 and reliably conveys the paper, sheet by sheet, by the function of the roller's frictional resistance.

Conveying roller 41*d* located on the most downstream side is positioned above conveying rollers 41*b* and 41*c,* so as to convey recording sheet upward.

The aforementioned pickup roller 41*a* and conveying rollers 41*b,* 41*c* and 41*d* constitute a recording paper conveying path S1.

On the other hand, paper feed cassette 42 is arranged under the image forming portion 108 and exposure unit 10 in housing 1*a,* so as to accommodate a large amount of recording sheets of a size specified by the specification of the apparatus or of a size that is determined beforehand by the user.

Arranged above one end side (the left-hand side in the drawing) of paper feed cassette 42 is a pickup roller 42*a.* A conveying roller 42*b* is also provided obliquely above and on the downstream side of the pickup roller 42*a* with respect to the recording paper feed direction (the direction of arrow D in the drawing).

Pickup roller 42*a* picks up one edge of the surface of the topmost recording sheet of a stack of recording sheets on paper feed cassette 42 and reliably feeds the paper, sheet by sheet, by the function of roller's frictional resistance.

Conveying roller 42*b* conveys the recording sheet delivered from pickup roller 42*a* upward along a recording sheet feed path S2 formed on one end side inside housing la to image forming portion 108.

Next, image output by color image forming apparatus 1 in the present embodied mode will be described.

Color image forming apparatus 1 is constructed so as to transfer the toner images formed on photoreceptor drums 21 to a recording sheet fed from paper feed portion 109 by a so-called intermediate transfer process, or via transfer belt unit 30.

First, charging device 22 uniformly electrifies the outer peripheral surface of photoreceptor drum 21 at a predetermined voltage.

The electrified photoreceptor drums 21 are irradiated with a laser beam from exposure unit 10, so that a static latent image for every color is formed on the photoreceptor drum 21 for each color.

Then, toner is supplied from developing device 23 to the outer peripheral surface of photoreceptor drum 21 so that the static latent image formed on the outer peripheral surface of photoreceptor drum 21 is visualized with toner (to be a toner image).

The toner images formed on photoreceptor drums 21 are transferred to transfer belt 31.

Transfer of the toner image from photoreceptor drum 21 to transfer belt 31 is done by intermediate transfer roller 35 arranged in contact with the interior side of transfer belt 31.

As intermediate transfer roller 35 is applied with a high voltage of a polarity (+) opposite to that of the polarity (−) of the electrostatic charge on the toner, transfer belt 31 has a high potential uniformly applied by the intermediate transfer roller 35, presents the opposite polarity (+). The toner image bearing negative (−) charge, on photoreceptor drum 21 is transferred to transfer belt 31 as the photoreceptor drum 21 turns and comes into contact with transfer belt 31.

The toner images of colors formed on respective photoreceptor drums 21 are transferred to transfer belt 31 as it moves, and overlaid one over another, thus a color toner image is formed on transfer belt 31.

In this way, the toner images developed from static latent images on photoreceptor drums 21 for every color, are laminated on transfer belt 31 so that the image for printing is reproduced as a multi-color toner image on transfer belt 31.

Then, as transfer belt 31 moves and reaches the position where the recording sheet and the transfer belt 31 meet, the multi-color toner image on transfer belt 31 is transferred from transfer belt 31 to the recording sheet by the function of transfer roller 36.

Since the toner adhering to transfer belt 31 as the belt comes in contact with photoreceptor drums 21, or the toner which has not been transferred to the recording sheet by transfer roller 36 and remains on transfer belt 31, would cause contamination of color toners at the next operation, it is removed and collected by transfer belt cleaning unit 37.

Next, the operation of feeding recording sheets by paper feed portion 109 will be described.

When recording paper placed on manual feed tray 41 is used, the paper is taken in by pickup roller 41*a* from manual feed tray 41, sheet by sheet, at controlled timings by instructions from the control panel (not shown), and fed into the machine.

The recording sheet thus taken into the machine is conveyed along recording paper feed path S1 by conveying rollers 41*b*, 41*c* and 41*d* to image forming portion 108.

When recording paper accommodated in paper feed cassette. 42 is used, the paper is separated and fed from paper feed cassette 42, sheet by sheet, by pickup roller 42*a*, and conveyed along recording paper feed path S2 to image forming portion 108.

The recording sheet conveyed from manual feed tray 41 or paper feed cassette 42 is delivered to the transfer roller 36 side, by registration roller 26, at such a timing as to bring the front end of the recording sheet in register with the leading end of the toner image on transfer belt 31, so that the toner image on transfer belt 31 is transferred to the recording sheet.

The recording sheet with a toner image formed thereon is further conveyed approximately vertically and reaches fixing unit 27, where the toner image is thermally fixed to the recording sheet by heat roller 27*a* and pressing roller 27*b*.

The recording sheet having passed through fixing unit 27, is discharged by discharge roller 28 when one-sided printing is selected, and placed face down on paper output tray 43.

In contrast, when double-sided printing is selected, the recording sheet is stopped and nipped by paper discharge roller 28, then the paper discharge roller 28 is rotated in reverse so that the recording sheet is guided to duplex printing paper path S3 and conveyed again to registration roller 26 by conveying rollers 29*a* and 29*b*.

By this movement, the printing face of the recording sheet is inverted and the direction of conveyance is reversed.

Illustratively, the leading edge of the sheet at the first printing is directed to the trailing end when the underside is to be printed, or the trailing edge of the sheet at the first printing is directed to the leading end when the underside is to be printed.

After the toner image is transferred and thermally fixed to the underside of the recording sheet, the sheet is discharged to paper output tray 43 by paper discharge roller 28.

Thus, the transfer operation to the recording sheet is done as described above.

Next, description will be made of how collecting port 38*a* of waste toner collecting container 38 is sealed.

FIG. 5 shows how air sealing member 40 is peeled off, and FIG. 6 shows how air sealing member 40 is used to seal.

In waste toner collecting container 38 where, as the collection of waste toner reaches the predetermined amount, coupling of the toner conveying member 39 is disengaged, air sealing member 40 disposed around each collecting port 38*a*, especially, second seal 49, is removed from second adhesive 48, as shown in FIG. 5.

Then, as shown in FIG. 6, each collecting port 38*a* is sealed by folding up the part other than opening 47*b* of first seal 47, i.e., the part 47*c*, toward the opening 47*b* side, so as to seal off the waste toner collecting container 38.

By this operation, it is possible to definitely seal the waste toner collecting container 38, which is removed from color image forming apparatus 1.

Figure 7:
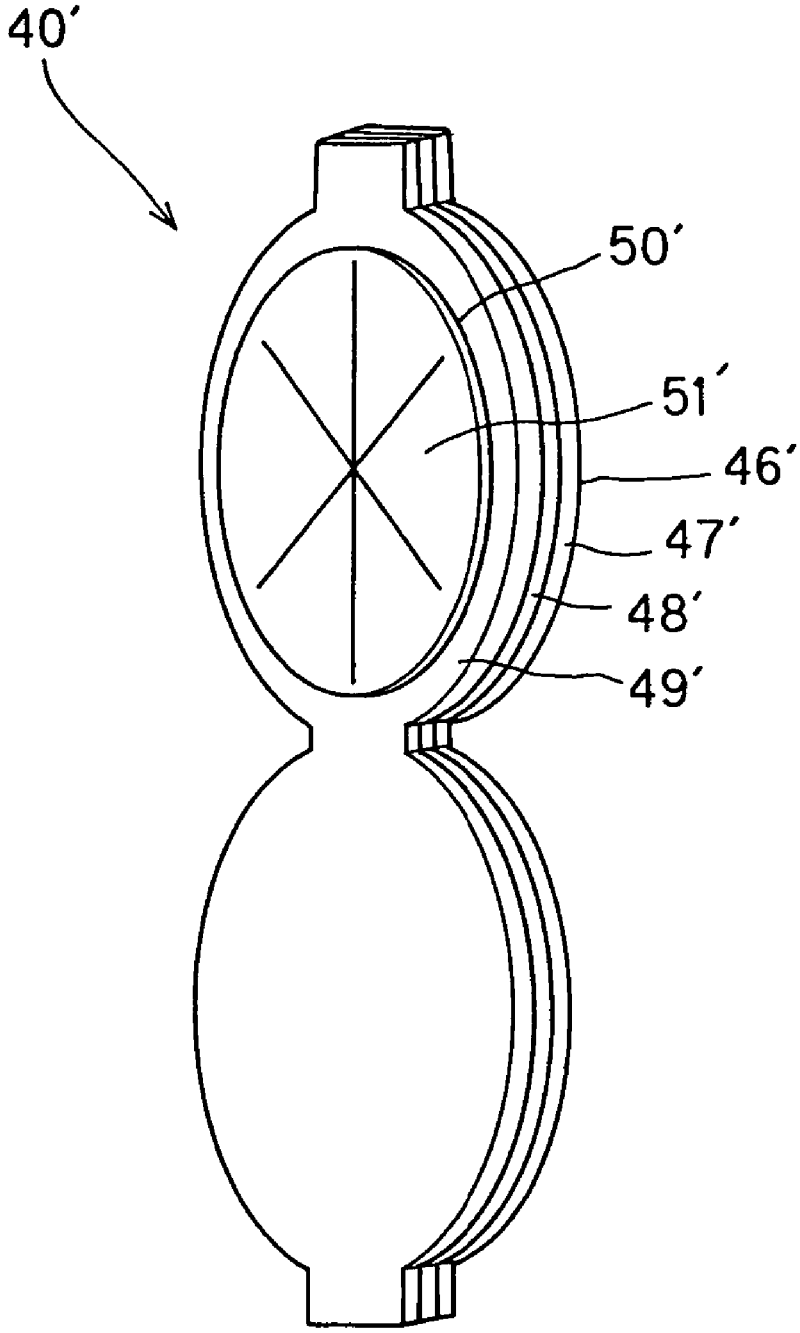
FIG. 7 is an illustrative view showing a second air sealing member.
Figure 8:
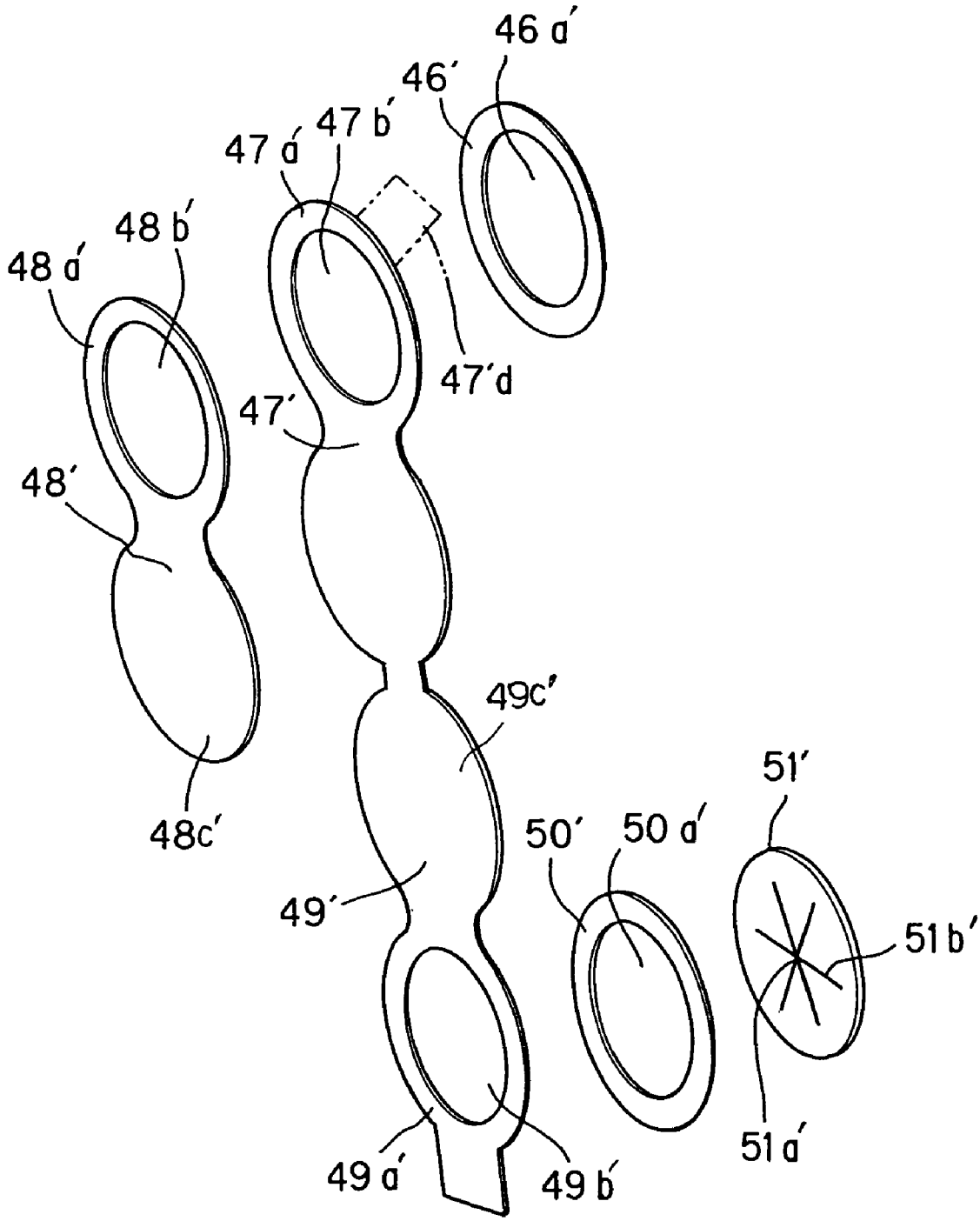
FIG. 8 is an exploded illustrative view showing parts of the second air sealing member.
Figure 9:
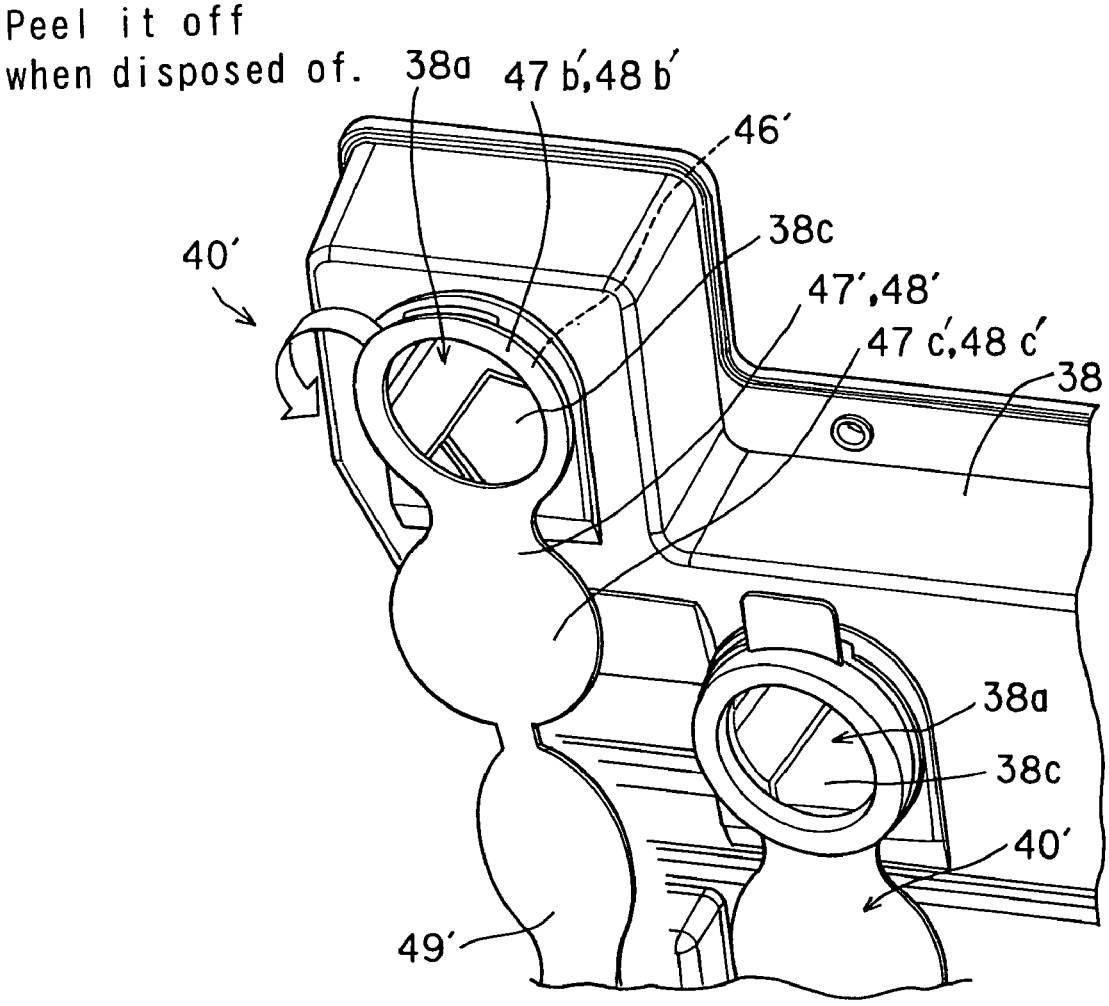
FIG. 9 is a view showing a state where an air sealing member is peeled off when the waste toner collecting container is full.

Referring next to FIGS. 7 to 9, description will be made of another configuration of an air sealing member in the image forming apparatus and waste toner collecting container of the above embodied mode, wherein a second air sealing member 40' having a different structure (to be referred to as "the second air sealing member embodiment") is adopted instead of the first air sealing member 40 (to be referred to as "the first air sealing member embodiment").

Since in this embodiment, the same components as in the above embodiment are employed except that the second air sealing member 40' is used instead of air sealing member 40, the corresponding components are allotted with the same reference numerals affixed with "'".

FIG. 7 is an assembly view showing the second air sealing member 40'. FIG. 8 is an exploded view for illustrating the second air sealing member 40'. FIG. 9 is a view showing a state where air sealing member 40' is peeled off when the waste toner collecting container 38 is full.

In this embodiment, the air sealing member 40' is composed of a first adhesive 46', first seal 47', second adhesive 48', second seal 49', third adhesive 50' and elastic element (made of elastic resin such as rubber, elastomer etc.) 51', all having openings (46*a*', 47*b*', 48*b*', 49*b*', 50*a*' and 51*a*'), respectively, corresponding to the aforementioned collecting port 38*a*, and laminated in the order mentioned, from the waste toner collecting container 38 side to the opposite side in the coupling 44 at which waste toner collecting container 38 is attached to color image forming apparatus 1.

In addition, as shown in FIG. 7, the lamination of first adhesive 46', first seal 47', second adhesive 48', second seal 49' and third adhesive 50' in the air sealing member 40' of the second embodiment is formed in a flat sheet-like configuration having greater planar dimensions compared to the thickness.

The aforementioned elastic element 51' has an essentially disk-like shape having radial slits 51*b*' from the center to its rim, so that the multiple projecting pieces sectioned by the slits 51*b*' opens and closes the opening 51*a*' when the central part is pushed in.

In other words, elastic element 51' is constructed such that the multiple projecting pieces sectioned by the aforementioned slits 51*b*' enclose opening 51*a*', projecting from the rim toward the central axis of opening 51*a*', and allow the opening 51*a*' to open when the projecting pieces are pushed.

Further, when toner conveying member 39 is attached to collecting port 38*a* of waste developer collecting container 38, the elastic element 51' is pushed apart by toner conveying member 39 so that the projecting pieces will be elastically deformed to open opening 51*a*', and when toner conveying member 39 is removed from the collecting port, the projecting pieces return to the position closing opening 51*a*'.

Accordingly, when waste developer collecting container 38 is attached to the image forming apparatus, toner conveying member 39 is pushed into the projecting pieces, passing through opening 51*a*' so that it can be attached to collecting opening 38*a*. On the other hand, upon removal, as toner conveying member 39 is drawn out from opening 51*a*', the projecting pieces elastically deform so as to reliably close opening 51*a*'. In this way, it is possible to automatically prevent waste developer from spilling out or scattering without the necessity of a special operation when waste toner collecting container 38 is detached.

First seal 47' and second seal 49' are joined to each other at their respective ends opposite to their respective openings with respect to the planar direction, and third adhesive 50' and elastic element 51' are laminated on second seal 49'.

The above configuration is that when unused waste toner collecting container 38 is mounted and that when the container is actually operated. Upon replacement of waste toner collecting container 38 when it is full, the user peels second seal 49' that is joined to first seal 47', together with third adhesive 50' and elastic element 51', from the opening side, and then sticks the thus peeled second seal 49' and elastic element 51' on the wall surface of waste toner collecting container 38, so as to provide the function of reliably preventing the waste toner adhering to elastic element 51' and others from scattering when the waste toner collecting container 38 is moved etc.

The difference between the air sealing member 40 of the first embodiment and the air sealing member 40' of the second embodiment is that the foaming 51, having an approximately annular section, used in the first embodiment is replaced by the sheet-like elastic element 51' having a plurality of slits 51*b*', in the second embodiment.

The reason for this modification is as follows. That is, waste toner collecting container 38 is not a component that will be fixed, once mounted, until it is full, but is opened and closed during actual usage, for example, upon replacement of the supplies for the main apparatus, or upon paper jam removal of conveyed sheets. At that time, the waste toner being conveyed through conveying screw 391 of toner conveying member 39 from each cleaning unit often resides in the area closer to the waste toner collecting container 38, within conveying screw 391. In the configuration where foaming 51 simply having an approximately circular opening is used to provide the sealing function when waste toner conveying screw 391 is inserted, the waste toner residing near the screw 391 exit may scatter outside waste toner collecting container 38 when waste toner collecting container 38 is opened and closed, causing contamination inside the machine.

For this reason, in the air sealing member 40' of the second embodiment, use of the sheet-like elastic element 51' having plural slits 51*b*' instead of the aforementioned foaming 51, makes it possible to take advantage of the elastic force of elastic element 51' with slits 51*b*' so as to prevent the waste toner in waste toner collecting container 38 from scattering outside the collecting container 38 when the container is opened and closed.

As described above, the second embodiment is modified in that (1) second seal 49' is joined to first seal 47'; and (2) elastic element (rubber) 51' is used instead of foaming 51, whereby the second embodiment adds improved effects as follows, compared to the first embodiment.

a. It is possible to avoid toner scattering when waste toner collecting container 38 becomes full and is to be discarded/collected, and avoid toner contamination when it is handled during disposal/collection work.

b. It is possible to reduce/eliminate waste toner scattering while the machine is in operation and hence eliminate scattering inside the machine.

The waste toner collecting container of the present invention should not be limited to the above embodiments, and various changes and modifications can be made without departing from the scope of the present invention.

What is claimed is:

1. A waste developer collecting container which is used in an image forming apparatus and can be removed therefrom and stores developer particles which, of the developer used for developing images of information formed on an electrostatic latent image bearing member, have not been transferred to a recording medium and have been collected as waste developer, wherein an air sealing member is disposed at the coupling between the waste developer collecting container and a conveying member for conveying the collected waste developer into the waste developer collecting container through a collecting port to prevent the waste developer from spilling out at the coupling when the waste developer is conveyed and to seal the collecting port so that no waste developer will spill out from the waste developer collecting container which has been removed for replacement after the waste developer collected and conveyed therein by the conveying member has reached a predetermined amount, the waste developer collecting container can be reused by attaching a new air sealing member around the collecting port of the waste developer collecting container, and the air sealing member comprises a seal, an adhesive and a waste developer anti-scatter member made of a foaming or an elastic element, laminated in the order mentioned, from the waste developer collecting container side to the opposite side in the coupling.

2. The waste developer collecting container for use in an image forming apparatus according to claim 1, wherein the air sealing member is composed of a first adhesive, a first seal, a second adhesive, a second seal, a third adhesive and a foaming, all having an opening corresponding to the collecting port, laminated in the order mentioned, from the waste developer collecting container side to the opposite side in the coupling.

3. The waste developer collecting container for use in an image forming apparatus according to claim 2, wherein the air sealing member attached to the waste developer collecting container is disposed at the coupling so as to allow a conveying member to be inserted through the opening.

4. The waste developer collecting container for use in an image forming apparatus according to claim 2, wherein the waste developer collecting container is sealed by the steps of peeling the second seal from the second adhesive of the air sealing member disposed around the collecting port after disengagement of the waste developer collecting container from the toner conveying member when the waste developer reaches the predetermined amount; and folding up the part other than the opening and therearound of the first seal toward the opening.

5. The waste developer collecting container for use in an image forming apparatus according to claim 4, wherein recycling of the waste developer collecting container is made possible by removing the entire air sealing member that is sealing the collecting port of the waste developer collecting container, or removing the first seal of the air sealing member and then placing a new air sealing member to the waste developer collecting container.

6. The waste developer collecting container for use in an image forming apparatus according to claim 1, wherein the air sealing member is composed of a first adhesive, a first seal, a second adhesive, a second seal, a third adhesive and an elastic element, all having an opening corresponding to the collecting port, laminated in the order mentioned, from the waste developer collecting container side to the opposite side in the coupling, and the elastic element is formed of a plurality of projecting pieces that project from the periphery thereof toward the central axis of the opening and cover the opening and is constructed such that the opening can be opened by pushing the projecting pieces.

7. The waste developer collecting container for use in an image forming apparatus according to claim 6, wherein the air sealing member is constructed such that when the conveying member is attached to the collecting port of the waste developer collecting container the projecting pieces are pushed apart by the conveying member so that the projecting pieces will be elastically deformed to open the opening and when the conveying member is removed from the collecting port, the projecting pieces return to the position closing the opening.

8. The waste developer collecting container for use in an image forming apparatus according to claim 6, wherein the elastic element has an essentially flat sheet-like configuration, cut by radial slits from the rim to the center, so that a plurality of projecting pieces attached at the rim are formed in the center.

9. The waste developer collecting container for use in an image forming apparatus according to claim 6, wherein the first seal and the second seal are joined to each other at their respective ends opposite to their respective openings with respect to the planar direction, and the third adhesive and the elastic element are laminated on the second seal, and upon replacement of the waste developer collecting container, the second seal is peeled off, together with the third adhesive and the elastic element, from the collecting port side, and the peeled second seal and the elastic element are made to stick to the wall surface of the collecting container.

* * * * *